US010456936B2

(12) United States Patent
Darwinkel et al.

(10) Patent No.: US 10,456,936 B2
(45) Date of Patent: Oct. 29, 2019

(54) ADJUSTABLE SPACING COMB, ADJUSTMENT DRIVE AND HAIR CUTTING APPLIANCE

(71) Applicant: KONINKLIJKE PHILIPS N.V., Eindhoven (NL)

(72) Inventors: Geert-Jan Darwinkel, Eindhoven (NL); Hendrik Klass Haagsma, Eindhoven (NL); Nicky Lewis, Eindhoven (NL); Matthew Gerard Nayna, Eindhoven (NL); Cornelis Johannes Zandsteeg, Eindhoven (NL); Hilde Seip, Eindhoven (NL); Auke Meint Jan Veninga, Eindhoven (NL); Jeroen Christian Nijdam, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 199 days.

(21) Appl. No.: 15/309,258

(22) PCT Filed: Apr. 15, 2015

(86) PCT No.: PCT/EP2015/058173
§ 371 (c)(1),
(2) Date: Nov. 7, 2016

(87) PCT Pub. No.: WO2015/169553
PCT Pub. Date: Nov. 12, 2015

(65) Prior Publication Data

US 2017/0072577 A1 Mar. 16, 2017

(30) Foreign Application Priority Data

May 9, 2014 (EP) ..... 14167674

(51) Int. Cl.
*B26B 19/20* (2006.01)
*B26B 19/38* (2006.01)

(52) U.S. Cl.
CPC ..... *B26B 19/20* (2013.01); *B26B 19/382* (2013.01); *B26B 19/388* (2013.01); *B26B 19/3813* (2013.01); *B26B 19/3886* (2013.01)

(58) Field of Classification Search
CPC ..... B26B 19/20; B26B 19/22; B26B 19/24; B26B 19/3806; B26B 19/3813;
(Continued)

(56) References Cited

U.S. PATENT DOCUMENTS 3,287,805 A * 11/1966 Du Charme ..... B26B 19/20 30/202
4,845,852 A * 7/1989 Sukow ..... B26B 19/20 30/201
(Continued)

FOREIGN PATENT DOCUMENTS

CN 202219512 U 5/2012
EP 2322328 A1 5/2011
(Continued)

*Primary Examiner* — Jason Daniel Prone

(57) ABSTRACT

An adjustment drive for an adjustable spacing comb for a hair cutting appliance that may be fitted with an adjustable spacing comb. The adjustment drive comprises an actuator for actuating a movable comb portion of the adjustable spacing comb with respect to a blade set of the hair cutting appliance, a manually operable rotation element, and a rotary encoder, that is configured to detect rotary movement of the rotation element and to output a respective user input signal, wherein the actuator is operated in response to the user input signal.

18 Claims, 6 Drawing Sheets

(58) Field of Classification Search
CPC . B26B 19/382; B26B 19/3826; B26B 19/388; B26B 19/3886
USPC ..... 30/194–203, 208–210, 233.5
See application file for complete search history.

(56) References Cited

U.S. PATENT DOCUMENTS 5,327,648 A * 7/1994 Ullmann ..... B26B 19/20 30/200
6,497,043 B1 * 12/2002 Jacobsen ..... B26B 21/40 30/34.05
6,634,104 B2 * 10/2003 Jacobsen ..... B26B 21/40 30/34.05
6,968,623 B2 11/2005 Braun
7,992,307 B2 8/2011 Smal
8,938,884 B2 * 1/2015 Kammer ..... B26B 19/3853 30/201
9,393,707 B2 * 7/2016 Wevers ..... B26B 19/20
9,833,914 B2 * 12/2017 Sobagaki ..... B26B 19/20
10,040,208 B2 * 8/2018 Darwinkel ..... B26B 19/20
2010/0083508 A1 4/2010 Cheng
2010/0186234 A1 * 7/2010 Binder ..... A45D 26/00 30/34.05
2012/0233865 A1 9/2012 Kammer
2012/0317817 A1 * 12/2012 Binder ..... A45D 26/00 30/34.05
2012/0320180 A1 * 12/2012 Binder ..... A45D 26/00 30/34.05
2013/0263457 A1 10/2013 Sobagaki
2016/0325443 A1 * 11/2016 Wevers ..... B26B 19/20
2017/0072577 A1 3/2017 Darwinkel
2017/0341245 A1 * 11/2017 Nayna ..... B26B 19/20

FOREIGN PATENT DOCUMENTS

EP 2500153 A2 9/2012
EP 2610039 A1 7/2013
WO 0249813 A1 6/2002
WO 2006134576 A2 12/2006
WO 2011073850 A1 6/2011

* cited by examiner

ADJUSTABLE SPACING COMB, ADJUSTMENT DRIVE AND HAIR CUTTING APPLIANCE

This application is the U.S. National Phase application under 35 U.S.C. § 371 of International Application No. PCT/EP2015/058173, filed on Apr. 15, 2015, which claims the benefit of International Application No. 14167674.2 filed on May 9, 2014. These applications are hereby incorporated by reference herein.

FIELD OF THE INVENTION

The present disclosure relates to an adjustment drive for an adjustable spacing comb for a hair cutting appliance, wherein the adjustment drive comprises an actuator that is configured for actuating a movable comb portion of the adjustable spacing comb with respect to a blade set of the hair cutting appliance. The present invention further relates to an adjustable spacing comb comprising an adjustment drive and to a hair cutting appliance that is fitted with an adjustable spacing comb. Moreover, the present invention further relates to a method for operating an adjustable spacing comb for a hair cutting appliance.

BACKGROUND OF THE INVENTION

Hair cutting appliances, particularly electric hair cutting appliances, are generally known and may include trimmers, clippers and shavers. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to trim (human) body hair, in particular facial hair and head hair to allow a person to have a well-groomed appearance. Frequently, electric hair cutting appliances are used for cutting animal hair.

EP 2 322 328 A1 discloses a hair cutting device having an interchangeable comb unit. The interchangeable comb unit comprises a comb identification member allowing the device to identify a hair length associated with the comb unit via a comb recognition arrangement present in the device's housing.

U.S. 2012/0233865 A1 discloses an adjustable comb assembly arranged to be attachable to an electric hair cutting appliance. The comb assembly comprises a knob allowing the user to rotatably adjust the cutting length setting of the comb assembly.

U.S. Pat. No. 6,968,623 B2 discloses a hair trimmer comprising a body, a cutting head including a blade set, an adjustable comb, wherein the comb is movable with respect to the blade set, an electric motor for driving the blade set to effect a cutting action, and an actuator assembly that is capable of moving the comb with respect to the blade set between a fully retracted position and a fully extended position, the actuator assembly comprising a comb carriage, a comb button connected to the comb carriage, wherein the comb button is actuatable to adjust the position of the comb relative to the blade set, and a lock button movable with respect to the comb button, wherein the lock button selectively prevents and permits movement of the comb button relative to the body. Consequently, manual adjustment of the length of the comb is enabled.

U.S. Pat. No. 7,992,307 B2 discloses a hair clipper comprising a housing and a motor which is connected by a shaft to a motorized cutting guide, wherein the cutting guide is driven by the motor, wherein the cutting guide is movable to a plurality of guide positions. Consequently, motorized adjustment of the length of the cutting guide (or comb) is enabled.

A comb for a hair cutting appliance, particularly a spacing comb, generally may be arranged as an attachable comb or an integrally formed comb. A spacing comb generally spaces a blade set of the hair cutting appliance from the skin when the appliance is moved in a moving direction with respect to the skin during operation. Consequently, the spacing comb may enable to cut hair to a desired length, i.e. to a desired length of remaining hair at the skin.

Conventional hair cutting appliances may be fitted with a set of attachment combs, each of which associated with a distinct hair length. Consequently, a user of the appliance basically needs to replace an attachment comb by another one to alter the hair cutting length. Furthermore, manually adjustable comb attachments are known, as disclosed in U.S. Pat. No. 6,968,623 B2. Furthermore, also powered adjustment combs have been presented in recent years, as for instance disclosed in U.S. Pat. No. 7,992,307 B2. Typically, powered adjustment combs comprise a movable comb portion that is movable with respect to a blade set of the hair cutting appliance, wherein the movable comb portion is coupled to an actuator, particularly to an electromotor and/or an electric powertrain.

However, operating a motorized adjustment comb frequently has proven to be afflicted with several drawbacks. It is often cumbersome for the user to operate the adjustable spacing comb in a precise and accurate manner since typically rather conventional control elements are provided, for instance push buttons, control levers etc. Typically, these control elements provide a predefined user input sensitivity. In other words, a single user input action may cause a defined response of the motor such that the adjustable spacing comb is displaced by a defined distance or step.

Consequently, coarsely positioning the adjustable spacing comb in the provided adjustment range (which may include covering considerably long distances in the adjustment range) may be experienced as time-consuming. Furthermore, fine adjustment of the adjustable spacing comb may be difficult since conventional control elements typically require considerably large minimum increments of the adjustment motion, as indicated above. Consequently, operating a motorized adjustable spacing comb by means of conventional control elements may be regarded as a trade-off between adjustment speed and adjustment precision.

Due to the above-mentioned lack of operating and adjusting efficiency of conventional adjustable spacing comb arrangements, operating the hair cutting appliance may be further complicated. It would be therefore advantageous to simplify the act of adjusting the spacing comb. It would be further advantageous to provide an adjustable spacing comb and an adjustment drive therefor that may be operated by the user in a time-efficient and highly accurate manner.

There is thus still room for improvement.

SUMMARY OF THE INVENTION

It is an object of the present invention to provide a hair cutting appliance, an adjustable spacing comb for a hair cutting appliance, and an adjustment drive for such an adjustable spacing comb that may overcome at least some of the above-mentioned problems. In particular, it is an object to provide an adjustment drive for an adjustable spacing comb that may ensure simplified operability and, more preferably, extended input options for a user. It would be further beneficial to seek for improvements in adjustment speed and adjustment precision and accuracy. It would be further advantageous to provide a corresponding method for operating an adjustable spacing comb.

According to a first aspect of the present disclosure, an adjustment drive for an adjustable spacing comb for a hair cutting appliance is presented, the adjustment drive comprising:

- an actuator that is configured for actuating a movable comb portion of the adjustable spacing comb with respect to a blade set of the hair cutting appliance,
- a manually operable rotation element, particularly a manually rotatable rotation element, and
- an encoder, particularly a rotary encoder, that is configured to detect rotatory movement of the rotation element and to output a respective user input signal,
- wherein the actuator is operated on the basis of the user input signal.

This aspect is based on the insight that the rotation element which may also be referred to as rotation wheel, may enable user input actions which may induce both precise positioning and quick positioning of the movable comb portion. On the one hand side, the user may rotate the rotation element slowly and by small (angular) increments. This may enable a precise positioning of the movable comb portion. On the other hand, the user may push or speed up the rotation element to considerable high revolution speeds making use of the rotation element's moment of inertia. Consequently, the rotation element may further rotate or spin even though the user no longer touches or contacts the rotation element. Once the rotation element is set into rotation, huge total rotation angles may be achieved. Consequently, the movable comb portion may be moved by a considerably long distance. Conversely, the user may slightly rotate the rotation element so as to move the movable comb portion by considerably small increments.

Generally, the rotation element may also be referred to as flywheel control element. It is particularly preferred that the rotation element is a rotatingly mounted rotation element comprising a considerable large moment of inertia. It is particularly preferred that the rotation element, once being accelerated by the user, may assume a flywheel-like behavior. In other words, kinetic energy may be stored in the flywheel-like rotation element which may basically cause the rotation element to rotate even further when the user releases grip or contact on rotation element.

Generally, the user may operate the rotation element with his/her fingers or thumbs. For instance, the user may accelerate or rotate the rotation element by pushing or pulling a circumferential portion of the rotation element.

The adjustment drive in accordance with the above aspect may have the further advantage that a single rotation element may be used for extending and retracting the movable comb portion. Basically, the rotation element may rotate clockwise and counter-clockwise. Consequently, the rotation may be "translated" into an extending or a retracting motion of the movable comb portion.

Generally, the encoder may be configured to detect angular motion, angular velocity and/or angular acceleration of the rotation element. Consequently, positioning speed, positioning distance, target positions, etc. may be specified by the user in large ranges by respectively operating or rotating the rotation element.

Generally, the encoder may be configured to output an electric user input signal that may take the form of an analog signal or a digital signal. The encoder may be arranged as an absolute encoder or an incremental encoder. The encoder may be arranged as an optical encoder and/or a capacitive encoder, for instance.

The adjustment drive according to the first aspect of the present invention further comprises a control unit coupled to the actuator and to the encoder, wherein the control unit is configured to convert the user input signal into an actuator operating signal. To this end, the adjustment drive may use a conversion algorithm. In the alternative, or in addition, the adjustment drive can make use of a characteristic mapping comprising respective pairs of user input signal values and corresponding actuator operating signal values.

By way of example, when the encoder is arranged as an absolute encoder, a distinct turning angle of the rotation element may be associated with a distinct absolute position of the movable comb portion with respect to the blade set. It is worth mentioning in this regard that the encoder may be arranged as a single-turn encoder or a multi-turn encoder.

In yet another embodiment, the encoder may be arranged as an incremental encoder. In other words, the encoder may be arranged as a relative encoder. An incremental encoder may be configured to detect incremental (rotational) position changes of the rotation element. Consequently, incremental position changes of the movable comb portion may be induced accordingly. It goes without saying that also a combination of absolute and incremental rotary motion detection may be utilized by the encoder and the respective control unit.

In some embodiments, the rotation element may be arranged as a multi-turn rotation element. Consequently, no limit stop(s) for the rotational movement is(are) provided. However, in some alternative embodiments, the rotation element may cooperate with respective limit stops that limit a maximum rotatory movement of the rotation element.

The control unit of the adjustment drive according to the first aspect of the present disclosure is configured to operate the movable comb portion such that an adjustment speed of the movable comb portion is a function of a difference between a normalized position of the rotation element and a normalized position of the movable comb portion. This function may be a proportional relation or a non-linear relation such as an exponentional or quadratic relation, for example. Consequently, the angular displacement of the rotation element may be used to set the adjustment speed or velocity of the movable comb portion. In the alternative, the angular velocity of the rotation element may set the adjustment velocity of the movable comb portion. The position of the rotation element and the position of the movable comb portion may be normalized so as to make to comparable.

The above embodiment may be further detailed in that the control unit is configured to operate the movable comb on the basis of the formula:

$$V_{comb}=K_{gain}*(X_{wheel}-X_{comb}),$$

wherein $V_{comb}$ is the adjustment speed of the movable comb portion, wherein $K_{gain}$ is a gain factor or coefficient, wherein $X_{wheel}$ is the rotational position of the rotation element, and wherein $X_{comb}$ is the position of the movable comb portion.

As indicated above, the algorithm can make use of absolute positions and/or relative positions. It may be further preferred to define limits for the resulting velocity of the movable comb portion $V_{comb}$. For instance, a speed range may be provided that comprises an upper and a lower border [minspeed, maxspeed]. Consequently, the adjustment speed $V_{comb}$ of the movable comb portion may be defined to be within the following range:

$$V_{comb}=\min(\max(V_{comb},\text{minspeed}),\text{maxspeed}).$$

Consequently, actuator overloads (or adjustment drive overloads) may be prevented.

Generally, detecting user inputs and operating the actuator accordingly may be conducted in accordance with the following procedure: Initially, the user moves or rotates the rotation element. Consequently, the encoder detects angular motion of the rotation element. Consequently, the control unit may detect a resulting difference between the (rotational) position of the rotation element and the actual comb position. Thereafter, the above (or a similar) formula may be applied to calculate the resulting comb adjustment speed in response to the user input. Consequently, the actuator may be operated so as to drive the adjustable spacing comb at the calculated adjustment speed. The act of comb adjustment may stop when the control unit determines that the (normalized) position of the rotation element corresponds to the (normalized) position of the movable comb portion.

In still another embodiment, the rotation element is a flywheel rotation element, wherein the rotation element further comprises a circumferential portion that is tangible for a user. Consequently, the user may touch, particularly push or pull, the circumferential portion so as to set the rotation element into rotation.

In still another embodiment, the rotation element is a high density rotation element comprising a significant moment of inertia. By way of example, the rotation element may be formed from a material that may comprise a considerably high volumetric mass density. For instance, the circumferential portion of the rotation element may be formed from metal material and/or rubber or rubber-like material. Generally, mass may be accumulated at the circumferential portion of the rotation element. In other words, material may be removed at a central portion of the rotation element.

In one embodiment, the rotation element of the adjustment drive is rotatably mounted at the hair cutting appliance, particularly rotatably supported at a housing portion of the hair cutting appliance. It is generally preferred that the rotation element is mounted in such a way with respect to the housing portion of the hair cutting appliance that smooth-running rotatory motion of the rotation element may be enabled. The above embodiment may be further developed in that the rotation element is at least partially covered by the housing portion, wherein a circumferential portion of the rotation element is accessible through an opening portion of the housing portion. Consequently, the rotation element may be perceived by the user as an integrated component of the hair cutting appliance, particularly of the housing portion thereof. In some embodiments, a locking member for the rotation element may be provided which selectively locks the rotation element with respect to the housing portion.

In still another embodiment, the rotation element may comprise a circumferential surface patterning, particularly a circumferential knurling. By way of example, a so-called criss-cross pattern may be generated at the circumferential portion of the rotation element. Knurling may involve linear knurling, diamond knurling and further knurling types. Basically, knurling allows the user to get a better grip on the rotation element. Consequently, the user may push or set the rotation element into even higher rotational speed. Also precisely operating the rotation element may be simplified in this way.

In the alternative, a better grip on the rotation element for the user may be achieved also by providing material at the circumferential portion that comprises considerably high friction coefficients. By way of example, rubber material or rubber-like material may be provided at the circumferential portion which may exhibit considerably high frictional forces.

In still another embodiment, the adjustment drive is further configured to provide feedback to a user, wherein a type of feedback is selected from a group consisting of tactile feedback, audio feedback, visual feedback, and combinations thereof.

By way of example, feedback to the user may be provided via a vibrating alert. The respective vibrations may be generated by the actuator itself or by a separate vibrating element. Audio feedback may be provided to the user by a buzzer or a similar element. Visual feedback may be provided to the user by the adjustable spacing comb itself since the movable comb portion is typically moved by distances that are clearly visible to the user. However, also separate visual indicator elements may be envisaged, e.g. active display elements.

According to another aspect of the present disclosure, an adjustable spacing comb for a hair cutting appliance is presented, the adjustable spacing comb comprising a movable comb portion that is movable with respect to a housing portion of the hair cutting appliance, and an adjustment drive in accordance with at least some embodiments discussed herein. Generally, the spacing comb may be arranged as an attachable and detachable spacing comb. In the alternative, the spacing comb may be arranged as an integrated or integrally provided spacing comb that cannot be detached from the hair cutting appliance. The movable comb portion may comprise a plurality of comb teeth that may divide and guide hairs when the hair cutting appliance including the adjustable spacing comb is moved through hair to cut hair to a selected length.

In yet another aspect of the present disclosure, a hair cutting appliance, particularly a hair trimmer or clipper, is presented, the hair cutting appliance comprising a housing portion, a cutting unit including a blade set, and an adjustable spacing comb in accordance with at least some embodiments described herein. Generally, the hair cutting appliance may be regarded as an electrically powered hair cutting appliance. Consequently, a motor may be provided for driving the blade set. Typically, the blade set may comprise a stationary blade and a movable blade, wherein the movable blade is movable with respect to the stationary blade. The movable blade may be driven with respect to the stationary blade, particularly oscillatingly driven. The movable blade and the respective stationary blade may comprise cutting edges that may cooperate to cut hair.

Generally, the hair cutting appliance may comprise an elongated housing comprising a first end and a second end which is opposite to the first end. At the first end of the housing, a cutting head may be arranged. The second end of the housing may also be referred to as handle end.

In one embodiment of the hair cutting appliance, the rotation element is mechanically unassociated with the actuator of the adjustment drive. This may particularly involve that the rotation element is mounted in a manner rotationally independent from the actuator. In other words, the rotation element is not mechanically linked to the actuator. Needless to say, the rotation element and the actuator may be coupled by the housing of the hair cutting appliance. However, despite of being arranged at or connected to the housing portion, the rotation element and the actuator of the adjustment drive may be mechanically independent from each other. In other words, signal lines or signal links for communication between the rotation element and the actuator may be provided. For instance, the rotation element and the actuator may be coupled via the control unit and the encoder.

In yet another embodiment of the hair cutting appliance, the rotation element is arranged at a location of the housing portion that is remote from the adjustment drive of the adjustable spacing comb. This may have the advantage that the rotation element may be basically arbitrarily positioned at the housing portion of the hair cutting appliance without the strong need to have consideration for the actual arrangement and/or configuration of the actuator. Consequently, the rotation element may be arranged at a user-friendly location of the housing portion which may further simplify operating the hair cutting appliance.

According to yet another aspect of the present disclosure, a method for operating an adjustable spacing comb for a hair cutting appliance is presented, the method comprising the following steps:

- providing an adjustment drive comprising an actuator for actuating a movable comb portion of the adjustable spacing comb,
- providing a manually operable rotation element, particularly a manually rotatable rotation element,
- detecting rotatory movement of the rotation element, wherein the rotary movement is induced by a user input motion,
- generating and outputting a respective user input signal, and
- operating the actuator on the basis of the user input signal.

Preferably, the method can make use of the adjustable spacing comb and the adjustment drive as discussed herein. Preferred embodiments of the disclosure are defined in the dependent claims. It shall be understood that the claimed method has similar and/or identical preferred embodiments as the claimed device and as defined in the dependent claims.

BRIEF DESCRIPTION OF THE DRAWINGS

These and other aspects of the invention will be apparent from and elucidated with reference to the embodiments described hereinafter. In the following drawings

DETAILED DESCRIPTION OF EMBODIMENTS

Figure 1:
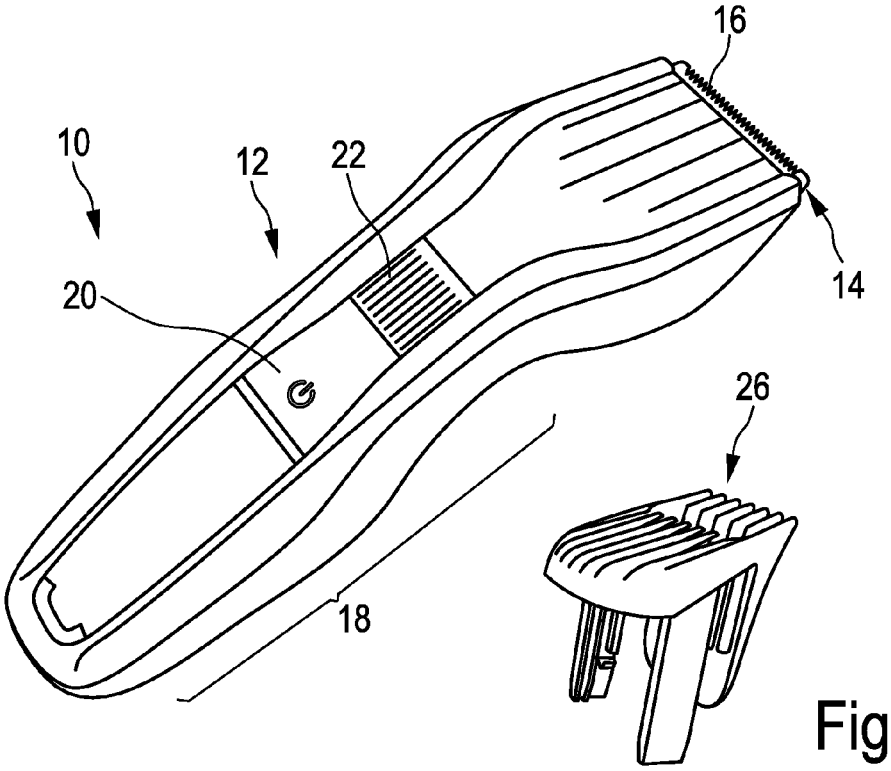
FIG. 1 shows a schematic perspective view of an exemplary embodiment of an electric hair cutting appliance and an adjustable spacing comb, wherein the spacing comb is shown in a detached state.

FIG. 1 shows a schematic perspective view of a hair cutting appliance 10, particularly an electrically operated hair cutting appliance 10. The hair cutting appliance 10 may also be referred to as hair clipper or hair trimmer. The hair cutting appliance 10 may comprise a housing or housing portion 12 having a generally elongated shape. At a first end thereof, a cutting unit 14 may be provided. The cutting unit 14 may comprise a blade set 16. The blade set 16 may comprise a movable blade and a stationary blade that may be moved with respect to each other to cut hair. At a second end of the housing portion 12, a handle or grip portion 18 may be provided. A user may grasp or grab the housing 12 at the grip portion 18.

The hair cutting appliance 10 may further comprise operator controls. For instance, an on-off switch or button 20 may be provided. Furthermore, a length adjustment control 22 may be provided at the housing 12 of the hair cutting appliance 10. The length adjustment control 22 may be provided in case an adjustable spacing comb 26 is attached to the housing 12 of the hair cutting appliance 10. In FIG. 1, the adjustable spacing comb 26 is shown in a detached or released state. When the spacing comb 26 is detached from the hair cutting appliance 10, a minimum cutting length may be achieved. When the spacing comb 26 is attached to the hair cutting appliance 10, hairs can be cut to a desired length.

Figure 2:
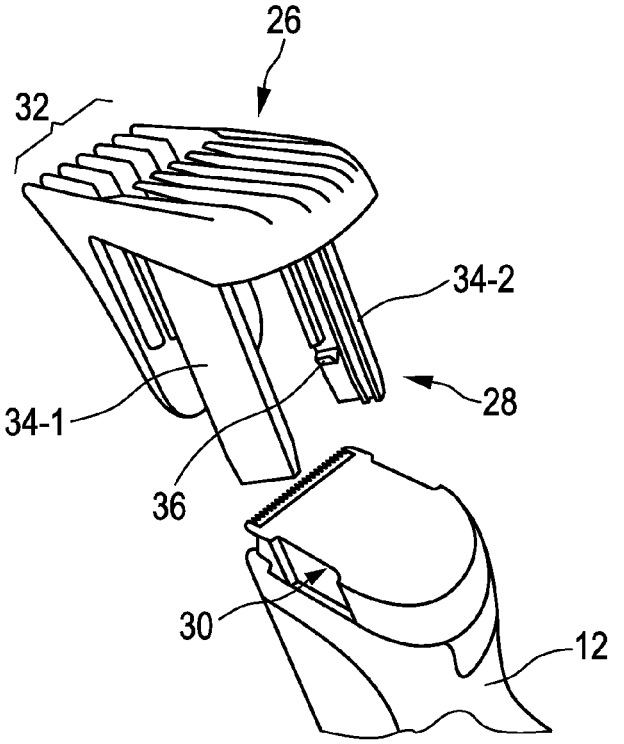
FIG. 2 shows a partial exploded view of yet another embodiment of a hair cutting appliance and an adjustable spacing comb, wherein the spacing comb is shown in an insertion orientation.

FIG. 2 shows a partial perspective schematic illustration of a first end of a housing portion 12 of a hair cutting appliance 10. Furthermore, an adjustable spacing comb 26 is shown in an insertion orientation. By way of example, the spacing comb may comprise an attachment portion 28 which may comprise, for instance, sliding beams 34-1, 34-2. The attachment portion 28 may engage the housing portion 12. More particularly, the attachment portion 28 may be inserted into respective slots at a mounting portion 30 of the housing portion 12. The sliding beams 34-1, 34-2 may be inserted into respective slots at the mounting portion 30. The attachment portion 28 may further comprise at least one snap-on member 36. The snap-on member 36 may secure the spacing comb 26 in its mounted state.

As can be further seen from FIG. 2, the spacing comb 26 may further comprise a toothed portion 32 including a plurality of comb teeth. Generally, the teeth of the toothed portion 32 may comprise a slot in which the blade set 16 may be movably arranged in the attached state.

Figure 3:
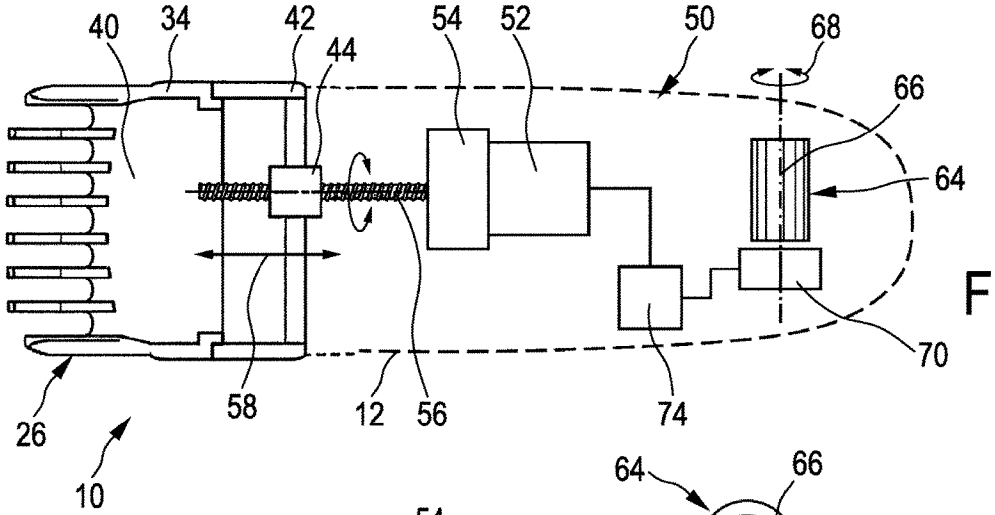
FIG. 3 shows a simplified top view of an exemplary embodiment of a hair cutting appliance fitted with an adjustable spacing comb and an adjustment drive for the spacing comb.
Figure 4:
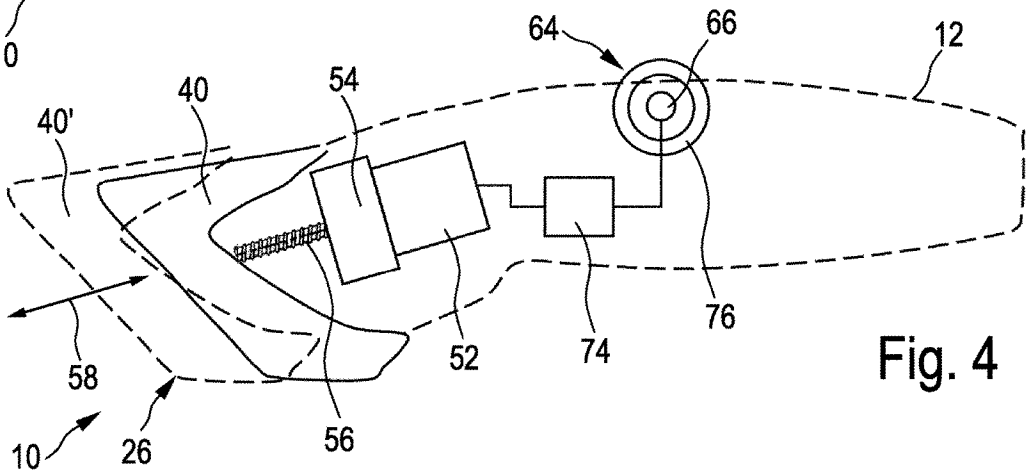
FIG. 4 shows a schematic simplified side view of an exemplary embodiment of a hair cutting appliance fitted with a retractable spacing comb and an adjustment drive for adjusting the spacing comb.

With further reference to FIG. 3 and FIG. 4, an exemplary embodiment of an adjustable spacing comb 26 and an embodiment of an exemplary adjustment drive 50 for operating the spacing comb 26 are further illustrated and described. FIG. 3 shows a schematic back view of a hair cutting appliance 10. FIG. 4 shows a schematic side view of a hair cutting appliance 10. It is worth mentioning in this regard that the views shown in FIG. 3 and FIG. 4 do not necessarily represent the same arrangement or embodiment. Respective housing portions 12 of the hair cutting appliance 10 are indicated in FIG. 3 and FIG. 4 by dashed lines. Consequently, internal components of the hair cutting appliance 10 are visible.

With particular reference to FIG. 3, the adjustable spacing comb 26 is further described. The adjustable spacing comb 26, refer also to FIG. 1 and FIG. 2, may comprise sliding beams 34 that may cooperate with a carriage 42 that is arranged at the housing 12. Generally, a snap-on mounting of the sliding beams 34 at the carriage 42 may be provided. At least a substantial portion of the spacing comb 26 may be regarded as movable comb portion 40. As can be best seen in FIG. 3, the movable comb portion 40 may be coupled to the carriage 42 and consequently moved with the carriage 42. For driving the carriage 42 and the movable comb portion 40, an engagement member 44 may be provided that is coupled to the carriage 42. For operating or driving the movable comb portion 40 with respect to the blade set 16 (refer to FIG. 1), an adjustment drive 50 may be provided which may also be referred to as adjustment powertrain. In other words, the adjustment drive 50 may be regarded as motorized adjustment drive 50.

The adjustment drive 50 may comprise an actuator 52 or, more particularly, an electromotor. The actuator 52 may be coupled to a reduction gear 54. The reduction gear 54 may be coupled to a transmission element 56. Generally, the transmission element 56 may be arranged to convert a rotational output motion of the actuator 52 and the reduction gear 54, if any, into a basically longitudinal positioning motion of the movable comb portion 40. A respective longitudinal direction is indicated in FIG. 3 and FIG. 4 by a double arrow denoted by reference numeral 58.

As can be seen from FIGS. 3 and 4, the transmission element 56 may be arranged as threaded spindle, particularly a small pitch spindle. Consequently, the transmission element 56 may be arranged to be set into rotational movements, refer to the curved arrow in FIG. 3. The transmission element 56 may be configured to engage the engagement member 44 so as to push or pull the carriage 42 and, consequently, the movable comb portion 40. In some embodiments, the transmission element 56 may be arranged as gear rack element. In some embodiments, the transmission element 56 may be arranged as push rod element. Generally, the actuator 52 may be mechanically connected to the carriage 42 and, in the mounted state, to the movable comb portion 40.

For operating the adjustment drive 50, respective control elements may be provided. To this end, the adjustment drive 50 may comprise an input rotation element 64, particularly a manually operable rotation element 64. Generally, the rotation element 64 may be formed in a basically rotationally symmetrical fashion. The rotation element 64 may be rotationally mounted. More particularly, the rotation element 64 may be mounted to the housing portion 12 or to an intermediate component that is attached to the housing portion 12. Generally, the rotation element 64 may be arranged to be rotated about a rotation axis 66, refer also to the curved double-arrow denoted by reference numeral 68 in FIG. 3. A user may operate or drive the rotation element 64 so as to control the adjustment drive 50 and, consequently, to adjust the movable comb portion 40 to a desired cutting length.

The rotation element 64 may be referred to as flywheel rotation element 64. The rotation element 64 may have a considerably high moment of inertia. Consequently, the user may set the rotation element 64 into rotation. Due to the moment of inertia, the rotation element 64 may basically maintain its rotation for a considerable time period. Consequently, a user may push or pull the rotation element 64 which may involve a single driving stroke. The rotation element 64 may then rotate "passively" for a considerably larger time period.

The rotation element 64 is coupled to an encoder 70. The encoder 70 may be configured to detect rotary or rotational movement of the rotation element 64. By way of example, the encoder 70 may comprise a Hall-sensor or a similar customary rotation sensor. Consequently, the encoder 70 may detect and output a user signal which is derivable from the user's driving stroke applied to the rotation element 64. The user input signal may be transferred to a control unit 74. The control unit 74 may comprise a processing unit. The control unit 74 may convert the detected user input signal into an actuator operating signal that may be transferred to the actuator 52. Consequently, there is no power transmission or force transmission link between the actuator 52 and the rotation element 64. Rather, electric signals may be transferred from the encoder 70 to the actuator 52 via the control unit 74.

The rotation element 64 may extend the range of possible user inputs that may be detected by a single operating element. As indicated above, the user may, on the one hand, precisely rotate the rotation element for precisely positioning the movable comb portion 40. On the other hand, the user may vigorously actuate the rotation element 64 which may cause significant rotation of the rotation element 64. Consequently, the movable comb portion 40 may cover long distances. In each case, the act of adjusting is user-friendly and time-efficient.

Further reference is made to FIG. 4. An extracted state of the movable comb portion 40' is indicated in FIG. 4 by a respective dashed line. As can be further seen from FIG. 4, a substantial portion of the rotation element 64, particularly a substantial circumferential portion, may be covered by the housing 12 of the hair cutting appliance 10. Consequently, a minor circumferential portion of the rotation element 64 may be accessible for the user. As can be further seen from FIG. 4, the rotation element 64 may comprise a circumferential mass accumulation 76. This may increase the moment of inertia of the rotation element 64.

Figure 5:
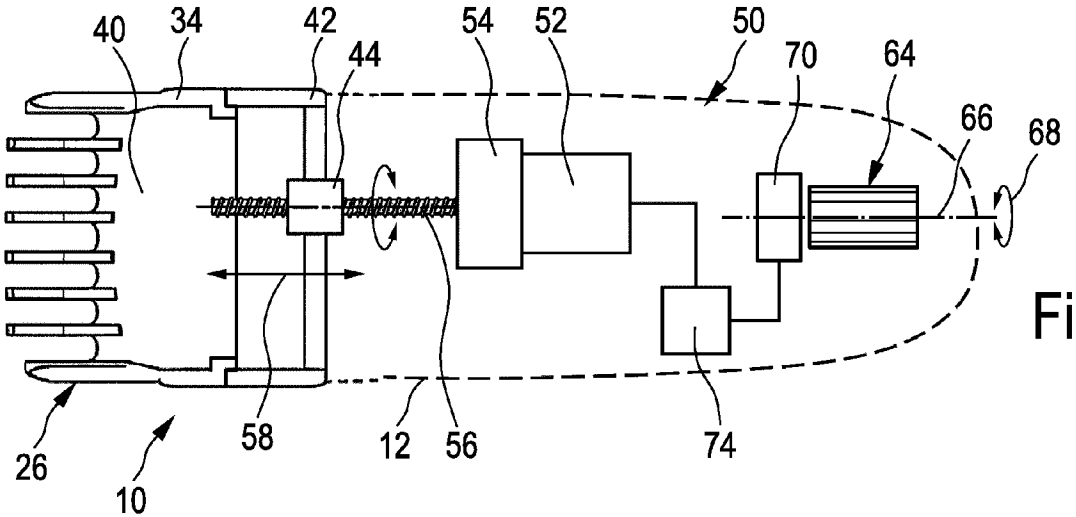
FIG. 5 shows a simplified top view of another exemplary embodiment of a hair cutting appliance fitted with an adjustable spacing comb and an adjustment drive for the spacing comb.
Figure 6:
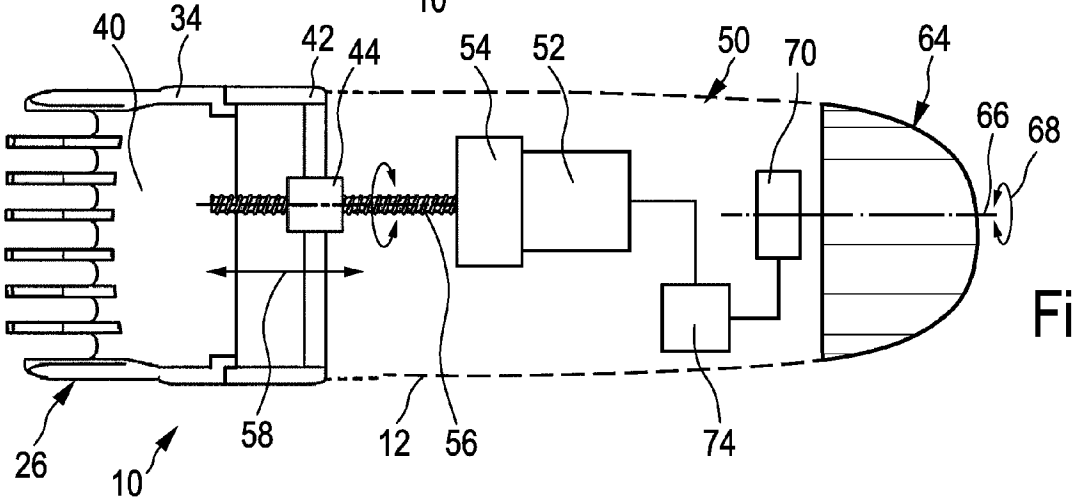
FIG. 6 shows a simplified top view of another exemplary embodiment of a hair cutting appliance fitted with an adjustable spacing comb and an adjustment drive for the spacing comb.

With particular reference to FIGS. 5 and 6, further exemplary arrangements of location detection units for hair cutting appliances 10 are illustrated and further described. With respect to their general design and layout, the hair cutting appliances 10 of FIGS. 5 and 6 may basically correspond the hair cutting appliance 10 illustrated in FIG. 3. In FIG. 5, the rotation axis 66 of the rotation element 64 is generally parallel or only slightly inclined with respect to a longitudinal extension of the elongated housing portion 12 of the hair cutting appliance 10. Generally, the housing portion 12 may extend from a first end and a second end which is opposite to the first end. At the first end of the housing portion 12, an adjustable spacing comb 26 may be attached. The second end of the housing portion 12 may also be referred to as handle end. The rotation axis 66 may at least partially extend through an opening in the housing portion 12.

Similarly, the rotation axis 66 of the rotation element 64 shown in FIG. 6 is generally parallel or only slightly inclined with respect to a longitudinal extension of the elongated housing portion 12. In FIG. 6, the rotation element 64 itself forms a handle end of the housing portion 12. Consequently, the handle end (formed by the rotation element 64) may be set into rotation with respect to the (remaining) housing portion 12, refer to a curved arrow denoted by reference numeral 68. The rotation element 64 of FIG. 6 is generally arranged as a rotational paraboloid or, more generally, as a rotationally symmetrical rotation element 64. However, at least in some embodiments, the rotation element 64 may be at least slightly flattened or similarly deformed.

Figure 7:
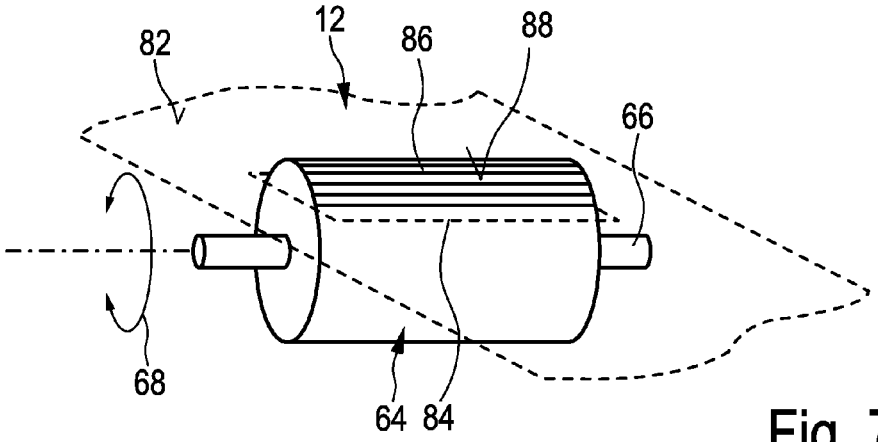
FIG. 7 shows a simplified schematic partial view of a housing portion of a hair cutting appliance wherein a rotation element for user inputs is shown in a partially covered state.

Further reference is made in this connection to FIG. 7. FIG. 7 shows a simplified perspective view of a housing surface 62 of a housing portion 12 of a hair cutting appliance 10, refer also to FIG. 4. The housing surface 82 may comprise an aperture or opening 84. Only a relatively small circumferential portion of the rotation element 64 may extend through the opening 84. A respective circumferential portion 86 that is accessible for the user is indicated in FIG. 7 by reference number 86. Generally, the rotation element 64 may comprise a non-slip surface 88. Particularly, the rotation element 64 or at least a circumferential portion 86 thereof may be formed from a material that provides a high friction coefficient. In the alternative, the circumferential portion 86 of the rotation element 64 may be coated with a respective high-friction material. By way of example, rubber or rubber-like materials have considerably high coefficients of friction.

Figure 8:
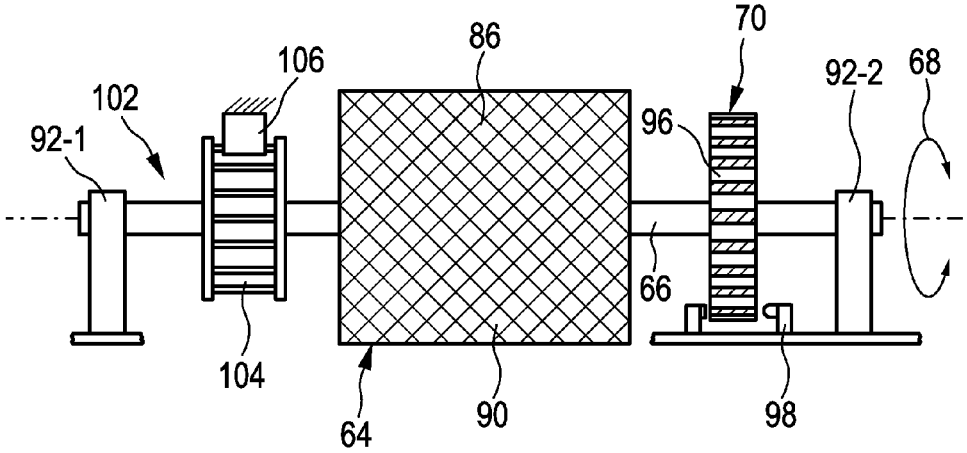
FIG. 8 shows a schematic simplified view of an exemplary rotation element for user inputs that is coupled with an encoder for detecting rotary movement of the rotation element.

FIG. 8 shows a schematic view of a rotatingly mounted rotation element 64 that is coupled with an encoder 70, particularly a rotatory encoder 70. In some embodiments, the rotation element 64 may comprise a cylindrical shape or a tubbish shape. Generally, the rotation element 64 may comprise a rotationally symmetric shape. At the circumferential portion 86 of the rotation element 64, a structured pattern 90, particularly a knurling pattern, may be provided. Generally, a number of recesses and/or indentations may be provided at the circumferential portion 86 which may improve the grip for the user. Knurling may involve diamond knurling, linear knurling or similar shapes.

As exemplarily shown in FIG. 8, the rotation element 64 may be coupled to a respective shaft or axis 66 that is mounted to at least one bearing 92-1, 92-2 for rotation, refer to the curved arrow denoted by reference numeral 68 in FIG. 8. Via the axis 66, the rotation element 64 may be coupled to the encoder 70. The encoder 70 may comprise a wheel 96 which may rotate with the rotation element 64. Furthermore, a detector or transceiver 98 may be provided that detects rotatory motion of the wheel 96 and, consequently, of the rotation element 64. It goes without saying that the detector or transceiver 98 may also be configured to directly detect rotatory motion at the rotation element 64 itself.

In still another embodiment, the rotation element 64 may be further coupled to a click mechanism 102. The click mechanism 102 may comprise a wheel 104, particularly a polygonal wheel or toothed wheel 104. The wheel 104 may be mounted to the axis 66 and may be further arranged to cooperate with a clicker element 106, particularly a clicker spring. The clicker element 106 may be coupled to or mounted at the housing portion 12, refer also to FIGS. 3 to 7. The clicker element 106 may engage the wheel 104. During rotation of the rotation element 64, the wheel 104 may also rotate with respect to the clicker element 106. Consequently, the clicker element 106 may alternatingly engage and disengage respective protrusions and indentations at the wheel 104. This may cause respective click noises. The click mechanism 102 may further inhibit excessive rotational motion of the rotation element 64. This may be beneficial to ensure that the rotation element 64 stops within respective time limits.

Figure 9:
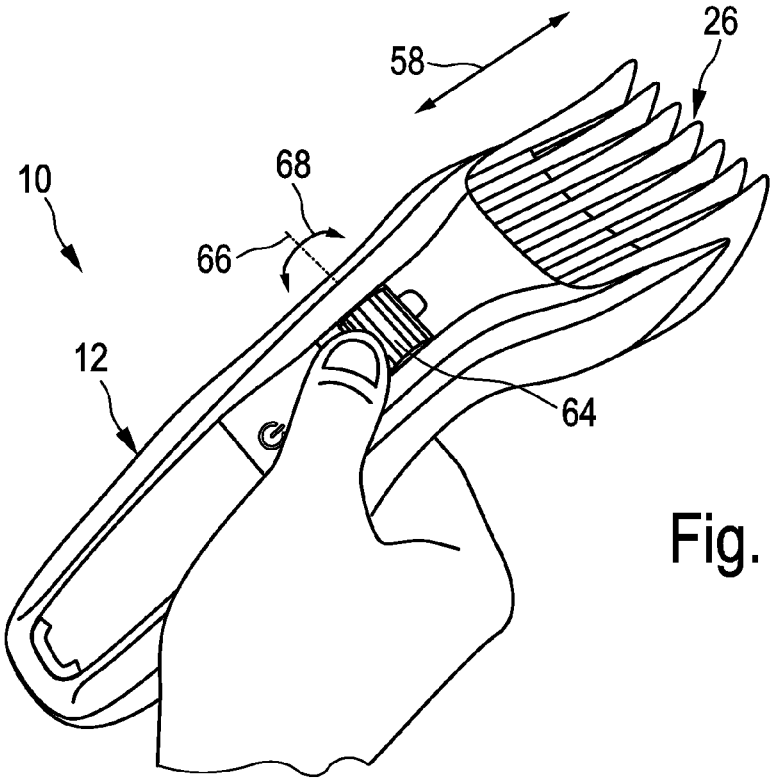
FIG. 9 is a schematic perspective view of an exemplary hair cutting appliance fitted with an adjustable spacing comb, the hair cutting appliance being held by a user that may operate a rotation element for operating an adjustment drive for the spacing comb.
Figure 10:
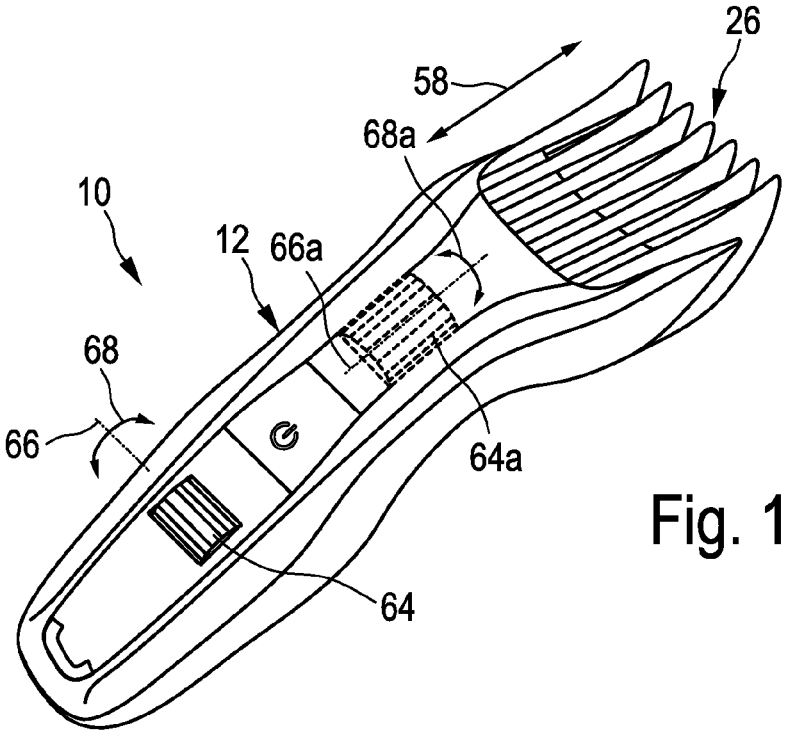
FIG. 10 is a schematic perspective view of yet another exemplary hair cutting appliance fitted with an adjustable spacing comb, wherein a rotation element for operating an adjustment drive for the spacing comb is arranged at a position that is different from the position illustrated in FIG. 9.

With further reference to FIG. 9 and FIG. 10, various positions of the rotation element 64 at the housing portion 12 of hair cutting appliances 10 are described. FIG. 9 shows a perspective view of a hair cutting appliance 10 held by a user. The user may operate the rotation element 64 with its thumb. As can be further seen from FIG. 9, the rotation element 64 may comprise a rotation axis 66 that is basically perpendicular to a general elongation direction of the housing portion 12. Operating the rotation element 64 and, consequently, the adjustment drive 50 (covered by the housing 12 in FIG. 9) may induce a respective extraction or retraction of the adjustable spacing comb 26 that is attached to the housing 12, refer also to the double-arrow denoted by reference numeral 58 in FIG. 9 and FIG. 10.

As can be further seen from FIG. 9, the rotation element 64 is arranged at a position of the housing portion 12 that may also be referred to as a central position. By contrast, FIG. 10 illustrates an arrangement of a respective rotation element 64 at a position of the housing portion 12 that may be referred to as lower portion and/or portion that is close to the second end of the housing portion 12. Since no mechanical (force transmission) link is required between the rotation element 64 and the actuator 52 of the adjustment drive 50 (not shown in FIGS. 9 and 10), the rotation element 64 may be arranged at arbitrary positions of the housing portion 12.

FIG. 10 further illustrates an alternative arrangement or an alternative orientation of a rotation element **64*a* which is indicated by dashed lines. A respective rotation axis 66*a* may be generally parallel to or only slightly inclined with respect to a main longitudinal extension of the housing portion 12. The rotation element 64*a* may be mounted in the housing portion 12 and at least slightly extend through an opening in the housing portion 12. The rotation element 64*a* may be actuated for rotation with respect to the housing portion 12, refer to the curved arrow denoted by reference numeral 68*a* in FIG. 10**.

Figure 11:
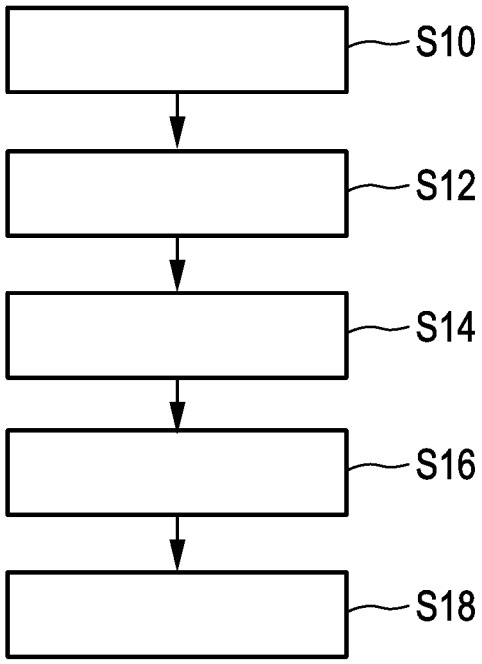
FIG. 11 shows an illustrative block diagram representing several steps of an embodiment of an exemplary method for operating an adjustable spacing comb for a hair cutting appliance in accordance with several aspects of the present disclosure.

With further reference to FIG. 11, an exemplary method of operating an adjustable spacing comb for a hair cutting appliance is illustrated and further described. The method may comprise a step S10 which may involve providing an adjustment drive that comprises an actuator for actuating a movable comb portion of an adjustable spacing comb of a hair cutting appliance. Preferably, the adjustment drive is shaped in accordance with at least some embodiments as disclosed herein. A further step S12 may follow which involves providing a manually operable rotation element, particularly a manually rotatable rotation element which is at least partially accessible for a user through an opening in a housing portion of the hair cutting appliance. A further step S14 may follow which may involve the detection of user inputs, particularly of rotatory movement of the rotation element which is induced by a user input motion, such as an accelerating input stroke. In a subsequent step S16, based on the detected rotary movement, a respective user input signal may be generated and provided for further processing. At still another step S18, the actuator of the adjustment drive may be operated on the basis of the user input signal. The step S18 may involve the conversion of the user input signal into an actuator operating signal. To this end, a control unit may be provided.

Figure 12:
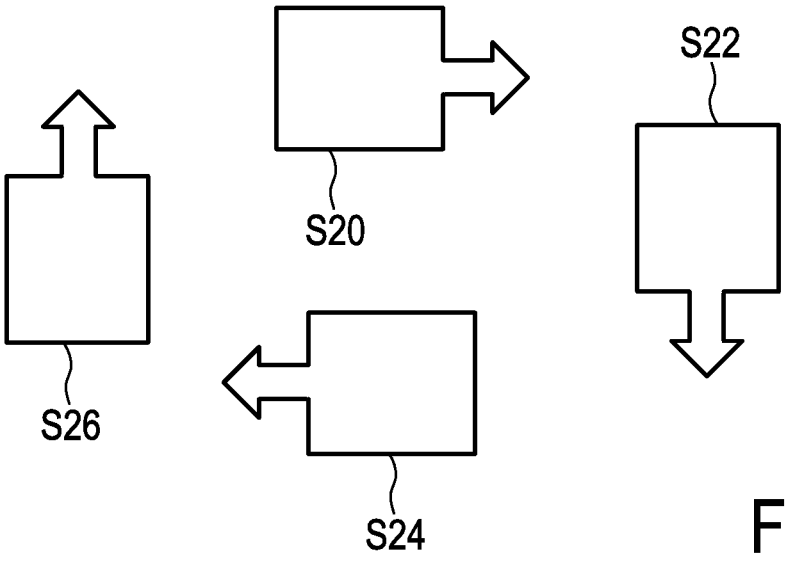
FIG. 12 shows yet another illustrative block diagram representing several steps of an exemplary algorithm for operating an adjustment drive for an adjustable spacing comb.

FIG. 12 illustrates several steps of a simplified algorithm for the detection of user inputs and for operating a movable comb portion of an adjustable spacing comb in accordance with the detected user inputs. A first step S20 may involve a user input action, particularly an actuation of a rotation element by the user. A further step S22 may follow which may involve the detection that a (normalized) position of the rotation element with respect to a (normalized) position of the movable comb portion has been altered. As already indicated above, the position of the rotation element and the position of the movable comb portion may be normalized to make them comparable. For instance, a normalized positional range may comprise values between 0 and 1.

In a further step S24, a desired moving speed of the movable comb portion in response to the detected user input may be calculated. Consequently, an operating signal may be generated that may be used to operate an actuator for moving the movable comb portion. A further step S26 may follow which may stop the movement of the movable comb portion when it is determined that the actual (normalized) position of the movable comb portion corresponds to the (normalized) position of the rotation element. The steps S20 to S26 may form a loop.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. An adjustment drive for an adjustable spacing comb for a hair cutting appliance comprising:

a housing portion, a cutting unit including a blade set, the adjustable spacing comb including: a movable comb portion movable with respect to the housing portion of the hair cutting appliance, the adjustment drive, and a manually operable rotation element configured to receive manually applied rotary movements by a user, the rotation element being rotatingly mounted to the adjustment drive and supported at the housing portion of the hair cutting appliance, the rotation element being at least partially covered by the housing portion, wherein a circumferential portion of the rotation element is accessible through an opening portion of the housing portion, the adjustment drive being manually operable by the rotation element, the adjustment drive comprising:

an actuator configured for actuating the movable comb portion of the adjustable spacing comb with respect to a blade set of the hair cutting appliance, a rotary encoder directly coupled to the rotation element and configured to detect rotary movements of the rotation element applied by a user, the rotary encoder being further configured to output a respective user input signal corresponding to the detected rotary movements applied by the user to the rotation element, and a control unit respectively coupled to the actuator and to the rotary encoder, wherein the control unit is configured to convert the detected user input signal output from the rotary encoder into an actuator operating signal, output by the control unit to the actuator to enable the control unit to electronically control the movable comb portion in response to the detected user inputs, wherein the control unit is further configured to move the movable comb portion in accordance with an adjustment position speed calculated as a function of a difference between relative positions between the rotation element and the movable comb portion.

2. The adjustment drive as claimed in claim 1, wherein the control unit is configured to operate the movable comb portion of the adjustable spacing comb on the basis of the formula:

$$V_{comb}=K_{gain}*(X_{wheel}-X_{comb}),$$

wherein $V_{comb}$ is the adjustment speed of the movable comb portion, wherein $K_{gain}$ is a coefficient, wherein $X_{wheel}$ is the rotational position of the rotation element, and wherein $X_{comb}$ is the position of the movable comb portion.

3. The adjustment drive as claimed in claim 1, wherein the rotation element is a flywheel rotation element, and wherein the rotation element comprises a circumferential portion that is tangible for the user.

4. The adjustment drive as claimed in claim 1, wherein the rotation element is a high-density rotation element comprising a moment of inertia.

5. The adjustment drive as claimed in claim 1, wherein the rotation element comprises a circumferential surface patterning.

6. The adjustment drive as claimed in claim 5, wherein the rotation element is at least partially covered by the housing portion, wherein a circumferential portion of the rotation element is accessible through and opening portion of the housing portion.

7. The adjustment drive as claimed in claim 5, wherein the circumferential surface patterning is a circumferential knurling.

8. The adjustment drive as claimed in claim 1, wherein the encoder is arranged as an absolute encoder such that a distinct turning angle of the rotation element is associated with a distinct absolute position of the movable comb portion with respect to the blade set.

9. The adjustment drive as claimed in claim 1, wherein the encoder is arranged as an incremental encoder such that incremental (rotational) position changes of the rotation element is associated with incremental position changes of the movable comb portion with respect to the blade set.

10. The adjustment drive as claimed in claim 1, wherein the adjustment drive is further configured to provide feedback to a user, wherein a type of feedback is selected from a group consisting of tactile feedback, audio feedback, visual feedback, and combinations thereof, wherein the tactile feedback is provided via one of vibrations generated by the actuator or by a separate vibrating element, wherein audio feedback is provided via an audible alarm, and wherein visual feedback is provided via the adjustable spacing comb.

11. The adjustment drive as claimed in claim 1, wherein the rotation element is rotatably, supported at the housing portion of hair cutting appliance.

12. A hair cutting appliance, comprising:

a housing portion, a cutting unit including a blade set, an adjustable spacing comb including a movable comb portion movable with respect to the housing portion of the hair cutting appliance, an adjustment drive configured for adjusting the adjustable spacing comb for the hair cutting appliance, and a manually operable rotation element rotatingly mounted to the adjustment drive, wherein the rotation element is rotatably supported at the housing portion of the hair cutting appliance and is at least partially covered by the housing portion, wherein a circumferential portion of the rotation element is accessible through an opening portion of the housing portion, the adjustment drive comprising:

an actuator configured for actuating a movable comb portion of the adjustable spacing comb with respect to the blade set of the hair cutting appliance, a rotation element rotatingly mounted to the adjustment drive and configured to receive from a user manually applied rotary movements of the rotation element, a rotary encoder directly coupled to the rotation element and configured to detect the user inputs applied by the user to the rotation element, the rotary encoder further configured to output a respective user input signal corresponding to the detected the manually applied rotary movements of the rotation element by the user to the rotation element, and a control unit respectively coupled to the actuator and to the rotary encoder, wherein the control unit is configured to convert the detected manually applied rotary movements of the rotation element applied by the user output from the rotary encoder into an actuator operating signal, output by the control unit to the actuator to enable the control unit to electronically control the movable comb portion in response to the detected said user manually applied rotary movements of the rotation element, wherein the control unit is further configured to move the movable comb portion in accordance with an adjustment position speed calculated as a function of a difference between the relative positions between the rotation element and the movable comb portion.

13. The hair cutting appliance as claimed in claim 12, wherein the rotation element is mechanically unassociated with the actuator of the adjustment drive, particularly wherein the rotation element is mounted in a manner that is rotationally independent from the actuator.

14. The hair cutting appliance as claimed in claim 12, wherein the rotation element is arranged at a location of the housing portion positioned to be accessible to a user without consideration of the position of or proximity to the adjustment drive of the adjustable spacing comb.

15. The hair cutting appliance as claimed in claim 12, wherein the hair cutting appliance is a hair trimmer.

16. The hair cutting appliance as claimed in claim 12, wherein the hair cutting appliance is a hair clipper.

17. A method for operating an adjustable spacing comb for a hair cutting appliance as claimed in claim 12, comprising the following steps:

providing the adjustment drive comprising the actuator for actuating the movable comb portion of the adjustable spacing comb, providing the manually operable rotation element, detecting rotary movement of the rotation element, wherein the rotary movement is induced by a user input motion, generating and outputting a respective user input signal, and operating the actuator in response to the user input signal;

wherein the actuator is operated based on a difference between a position of the rotation element and a position of the movable comb portion, preferably on a difference between a normalized position of the rotation element and a normalized position of the movable comb portion such that the adjustment speed of the moveable comb portion is a function of said difference.

18. An adjustable spacing comb for a hair cutting appliance, comprising an adjustment drive, the adjustment drive comprising:

an actuator configured for actuating the movable comb portion of the adjustable spacing comb with respect to a blade set of the hair cutting appliance, a rotary encoder directly coupled to the rotation element and configured to detect rotary movement of the rotation element, and in particular the user inputs applied by the user to the rotation element, the rotary encoder being further configured to output a respective user input signal corresponding to the detected user inputs applied by the user to the rotation element, and a control unit respectively coupled to the actuator and to the rotary encoder, the control unit being configured to convert the detected user input signal output from the rotary encoder into an actuator operating signal, output by the control unit to the actuator to enable the control unit to electronically control the movable comb portion in response to the detected user inputs, the control unit being further configured to move the movable comb portion in accordance with an adjustment position speed calculated as a function of a difference between relative positions between the rotation element and the movable comb portion.

* * * * *